US008119956B2

(12) United States Patent
Janik et al.

(10) Patent No.: US 8,119,956 B2
(45) Date of Patent: Feb. 21, 2012

(54) MULTI-STAGE HYPER-VELOCITY KINETIC ENERGY MISSILE

(75) Inventors: Richard Janik, Tucson, AZ (US); Doron Strassman, Vail, AZ (US)

(73) Assignee: Raytheon Company, Waltham, MA (US)

( * ) Notice: Subject to any disclaimer, the term of this patent is extended or adjusted under 35 U.S.C. 154(b) by 271 days.

(21) Appl. No.: 12/563,855

(22) Filed: Sep. 21, 2009

(65) Prior Publication Data

US 2010/0084505 A1 Apr. 8, 2010

Related U.S. Application Data

(60) Provisional application No. 61/102,094, filed on Oct. 2, 2008.

(51) Int. Cl.

| | |
|---|---|
| ***F42B 15/01*** | (2006.01) |
| ***F42B 15/04*** | (2006.01) |
| ***F42B 12/32*** | (2006.01) |
| *F42B 15/00* | (2006.01) |
| *F42B 12/00* | (2006.01) |

(52) U.S. Cl. ..... 244/3.12; 244/3.1; 244/3.11; 244/3.14; 244/3.15; 244/3.19; 102/473; 102/489; 102/501; 102/517

(58) Field of Classification Search ..... 244/3.1–3.3; 102/473, 475, 501, 517, 489; 89/1.11
See application file for complete search history.

(56) References Cited

U.S. PATENT DOCUMENTS 3,464,356 A * 9/1969 Salzman et al. ..... 244/3.16
3,561,362 A 2/1971 Black et al.
3,762,666 A * 10/1973 Thompson ..... 244/3.19
(Continued)

FOREIGN PATENT DOCUMENTS

WO 9000244 A1 1/1990
(Continued)

OTHER PUBLICATIONS

Anonymous: "TOW 2 Heavy Anti-Tank Missile, USA," Jul. 2, 2008, retrieved from internet URL: http://web.archive.org/web/20080702053, 249/ http://www.army-technology.com/projects/tow.

*Primary Examiner* — Bernarr Gregory
(74) *Attorney, Agent, or Firm* — Eric A. Gifford

(57) ABSTRACT

A multi-stage hyper-velocity kinetic energy missile (HVKEM) uses a 'missile in a missile' architecture in which the HVKEM includes a 1st stage flight missile and a 2nd stage kill missile that includes a KE-rod penetrator. The flight missile cruises at a relatively low velocity (less than Mach 1.5, typically less than Mach 1) to conserve propellant (weight) and to allow for effective guidance and maneuvering until the missile is in close proximity to the target. When the missile is within the lethal range of the KE-rod penetrator, the kill missile separates and boosts to a much higher velocity (greater than Mach 3, typically greater than Mach 5) and flies unguided to impact the target in less than a second. Waiting to boost the KE-rod until "the last second" reduces the total propellant (weight) needed to deliver the KE-rod on target and simplifies the guidance. The missile may be configured for use with different platforms and different guidance systems but is particularly well suited for use with the existing base of TOW launch containers and platforms satisfying all of the physical, operational and CLOS guidance constraints while maintaining the performance of the KE-rod penetrator.

15 Claims, 12 Drawing Sheets

U.S. PATENT DOCUMENTS 4,791,850 A * 12/1988 Minovitch ..... 244/3.2
5,834,684 A * 11/1998 Taylor ..... 244/3.28
5,988,071 A * 11/1999 Taylor ..... 244/3.3
6,021,716 A * 2/2000 Taylor ..... 244/3.28
6,494,140 B1 12/2002 Webster
6,568,627 B1 * 5/2003 Jones et al. ..... 244/3.13
6,779,462 B2 * 8/2004 Lloyd ..... 102/475
7,448,324 B1 * 11/2008 King et al. ..... 102/517
7,645,969 B2 * 1/2010 Gnemmi et al. ..... 244/3.1

FOREIGN PATENT DOCUMENTS

WO 0058684 A1 10/2000

* cited by examiner

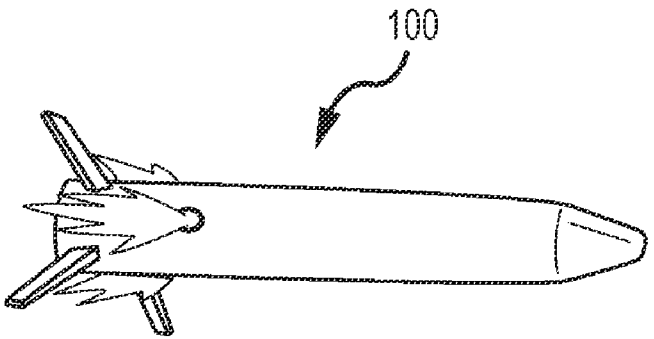
FIG.6b
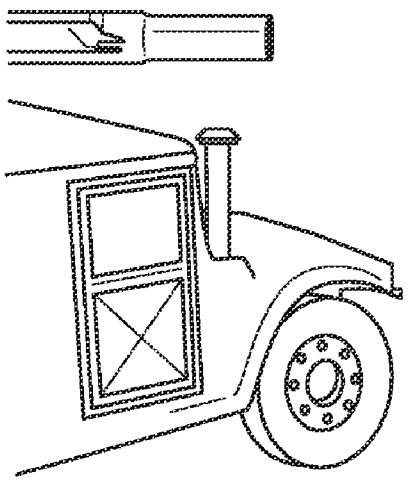

MULTI-STAGE HYPER-VELOCITY KINETIC ENERGY MISSILE

CROSS-REFERENCE TO RELATED APPLICATIONS

This application claims benefit of priority under 35 U.S.C. 119(e) to U.S. Provisional Application No. 61/102,094 entitled "Multi-Stage Hyper-Velocity Kinetic Energy Missile" and filed on Oct. 2, 2008, the entire contents of which are incorporated by reference.

BACKGROUND OF THE INVENTION

1. Field of the Invention

This invention relates to a multi-stage hyper-velocity kinetic energy (KE) missile. The missile may be configured for use with different platforms and different guidance systems but is particular well suited for use with a class of tactical missiles including an existing base of Tube-Launched, Optically-Tracked, Wire-Guided (TOW) launch platforms using command line of sight (CLOS) guidance to provide hyper-velocity KE-rod penetrator capability.

2. Description of the Related Art

The TOW missile was first produced in 1970 and is the most widely used anti-tank guided missile in the world. As shown in FIGS. 1*a*-1*b* and 2*a*-2*b*, a standard TOW missile 10 is a single-stage missile that delivers a chemical explosive to pierce the armor and destroy the tank. The missile is stored in a tow launch container (TLC) 12 that accommodates a missile of no more than 5 feet in length, 6 inches in diameter and at most 70 lbs. The TLC is mounted on a TOW platform such as a Bradly 14, Stryker 16, Humvee, Jeep, Helicopter etc.

The TOW weapons system uses CLOS to acquire, aim and maneuver the TOW missile to impact a target. This means that the guidance system is directly linked to the platform, and requires that the target be kept in the shooter's line of sight until the missile impacts. A typical TOW system uses Semi-Automatic CLOS in which target tracking is performed manually by an operator while missile tracking and control is automatic. The CLOS system 18 includes an optical sensor on the launch platform that images both the target and a beacon on the back of the TOW missile. The CLOS system uses only the angular coordinates between the missile and the target to ensure the collision. The missile will have to be in the line of sight between the launcher and the target (LOS), correcting any deviation of the missile in relation to this line. Early versions of TOW transmitted the guidance commands from the platform to the TOW missile over a wire, hence the name "Wire-Guided". More recent versions have replaced the wire with an RF link. The TOW missile includes a CLOS flight control system 20 to maneuver the missile in response to the received guidance commands to impact the target. For a human operator to effectively target and maneuver the TOW missile to impact the target, the flight velocity of the TOW is less than Mach 1.5 and typically sub-sonic (i.e. less than Mach 1). There is a direct trade off of velocity to close the range to target versus the ability of an operator to control the missile.

The standard TOW missiles have been widely used against armour in the past and still have a role but are less effective against modern composite armour. Weapons systems that use KE-rod penetrators are being developed that are capable of piercing modern composite armour. The principle of the kinetic energy penetrator is that it uses its kinetic energy, which is a function of mass and velocity, to force its way through armour. The modern KE weapon maximizes KE and minimizes the area over which it is delivered, e.g. a metal rod several feet in length and approximately one inch in diameter travelling at hyper-velocities (>Mach 5).

The industry has been endeavoring for several years to develop a hyper-velocity KE missile that is backward compatible with both the operational and physical constraints of the existing deployed base of TLC and TOW platforms. The cost of discarding or modifying the TOW infrastructure is simply prohibitive. Such a missile would have to satisfy the size and weight constraints of the TLC, operational constraints of storing, loading and firing the missile and the guidance constraints of CLOS guidance. The missile would also have to satisfy the performance constraints of a KE-rod penetrator to deliver the penetrator on target at hyper-velocity.

One example of a KE-rod penetrator is the LM CKEM/LOSAT class of missiles that boost the missile to hyper-velocity over the entire effective range to target. These missiles are heavy, 100 lbs or more, and require a different guidance system. A human operator cannot target and maneuver a missile at hyper-velocity. Furthermore, the propellants required for hyper-velocity are very 'smokey' which occludes the operator's vision of the target.

Another example of a KE-rod penetrator is the HATEM class of missiles that boost the missile to hyper-velocity, separate the free-flying KE-rod (no separate boost capability) and guide the rod to impact the target. These missiles are heavy, 100 lbs or more and CLOS is not effective for the same reasons of hyper-velocity and the smoke cloud and additionally because the small diameter rod does not support the required beacons.

With the repeated failure of different KE architectures to both satisfy the TOW physical, operational and guidance constraints while providing effective KE performance the industry is largely resigned that KE technology cannot be effectively retrofitted to the TOW platform. The consensus is that the amount of propellant required for hyper-velocity flight will violate the size and weight constraints and that hyper-velocity flight is incompatible with CLOS guidance.

SUMMARY OF THE INVENTION

The present invention provides a multi-stage hyper-velocity kinetic energy (KE) missile. The missile may be configured for use with different platforms and different guidance systems but is particularly well suited for use with the existing base of TOW launch containers and platforms satisfying all of the physical, operational and guidance constraints while maintaining the performance of the KE-rod penetrator.

This is accomplished with a 'missile in a missile' architecture in which the hyper-velocity KE missile (HVKEM) includes a $1^{st}$ stage flight missile and a $2^{nd}$ stage kill missile that includes a KE-rod penetrator. The flight missile cruises at a relatively low velocity (less than Mach 1.5) to conserve propellant (weight) and to allow for effective guidance and maneuvering until the missile is in close proximity to the target. In general, guidance of the flight missile may be CLOS, fire-and-forget etc. When the missile is within the lethal range of the KE-rod penetrator, the kill missile separates and boosts to a much higher velocity (greater than Mach 3) and flies unguided to impact the target in less than a second. Waiting to boost the KE-rod until "the last second" reduces the propellant (weight) needed to deliver the KE-rod on target and simplifies the guidance.

In a TOW-compatible configuration, the flight missile includes launch and flight motors to fly the HVKEM at less than Mach 1.5 and typically sub-sonic velocities and a CLOS flight control subsystem to maneuver the missile to the target in response to guidance commands received from the CLOS system on the TOW platform. Non-smokey propellant can be used to achieve and sustain velocities less than Mach 1.5. The kill missile includes a range sensor to detect when the target is within lethal range of the KE-rod penetrator to trigger separation of the kill missile from the flight missile and ignition of a boost motor to boost the kill missile to >Mach 3 and typically hyper-velocity to impact the target. The lethal range is limited to a few hundred meters from impact such that separation occurs less than 1 second prior to impact. At this range, no additional guidance of the KE-rod is required or is practical. Consequently, the smokey propellants used to achieve greater than Mach 3 and hyper-velocities do not pose a problem. The combination of only boosting the kill missile to hyper-velocity and waiting to do so until less than one second to impact allows the 'missile in a missile' design to satisfy the physical size and weight constraints, operational constraints and the CLOS guidance constraints while delivering the KE-rod on target at sufficient velocity to kill the target.

These and other features and advantages of the invention will be apparent to those skilled in the art from the following detailed description of preferred embodiments, taken together with the accompanying drawings, in which:

BRIEF DESCRIPTION OF THE DRAWINGS

FIGS. 6*a*-6*e* are a sequence of diagrams illustrating the launch of the hyper-velocity KE missile from a standard TOW launch container and TOW platform using CLOS guidance;

DETAILED DESCRIPTION OF THE INVENTION

The present invention provides a multi-stage hyper-velocity kinetic energy (KE) missile. The missile may be configured for use with different platforms and different guidance systems but is particularly well suited for use with the existing base of TOW launch containers and platforms satisfying all of the physical, operational and guidance constraints while maintaining the performance of the KE-rod penetrator.

This is accomplished with a 'missile in a missile' architecture in which the hyper-velocity KE missile (HVKEM) includes a $1^{st}$ stage flight missile and a $2^{nd}$ stage kill missile that includes a KE-rod penetrator. The flight missile cruises at a relatively low velocity (less than Mach 1.5) to conserve propellant (weight) and to allow for effective guidance and maneuvering until the missile is in close proximity to the target. Guidance of the flight missile may be CLOS, fire-and-forget etc. When the missile is within the lethal range of the KE-rod penetrator, the kill missile separates and boosts to a much higher velocity (greater than Mach 3) and flies unguided to impact the target in less than a second. Waiting to boost the KE-rod until "the last second" reduces the propellant (weight) needed to deliver the KE-rod on target and simplifies the guidance.

Without loss of generality, the 'missile in a missile' architecture will be described for a TOW compatible system. TOW compatibility places constraints on the missile to use CLOS guidance, which in turn places a constraint of a cruising speed for the missile of less than Mach 1.5 and often less than Mach 1 in order to command guide the missile to the target. TOW compatibility also places size and weight constraints on the missile to fit inside and function with a tow launch container such as the TOW 2B MLC. The physical constraints, operation and guidance of the HVKEM on a TOW platform are unchanged. The TLC includes a resistor that is connected to the CLOS system, the value of the resistor indicating what TOW missile is stored in the TLC. Consequently, the HVKEM will have a different value of resistor. When detected, the CLOS display will show an icon such as "HV-TOW", for example to indicate the missile. As will be discussed in more detail below, the HVKEM can be configured and operated in either of two operated selected modes. A $1^{st}$ mode in which the kill missile separates, boosts to a velocity greater than Mach 3 and impacts the target and a $2^{nd}$ mode in which the kill missile does not separate and the flight missile flies at less than Mach 1.5 to impact the target thereby detonating the propellant of the kill missile boost motor. To the operator of the TOW system, the only difference is the appearance of the HV-TOW icon and the choice of the two modes of operation, launch and command guidance of the HVKEM to the target is identical.

Figure 1A:
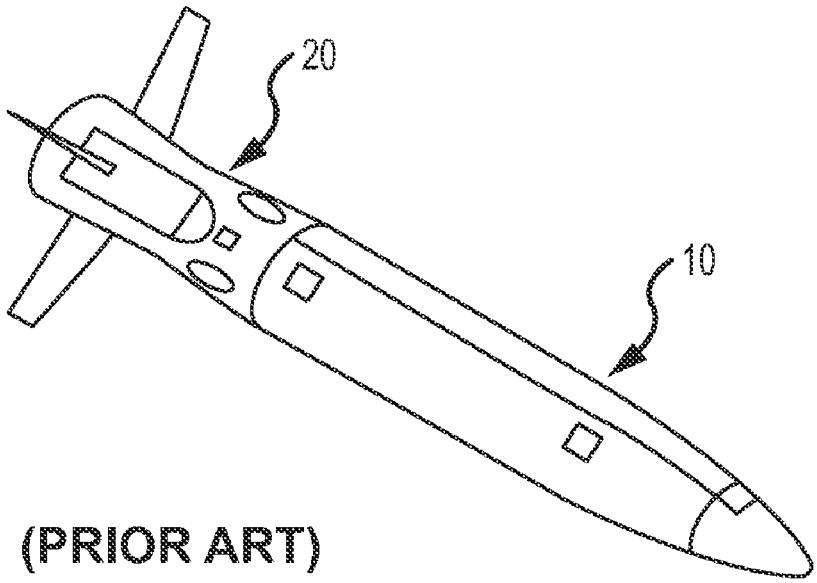
(PRIOR ART) FIG.1a
FIGS. 1*a* and 1*b*, as described above, are diagrams of a standard TOW missile and TOW launch container.
Figure 1B:
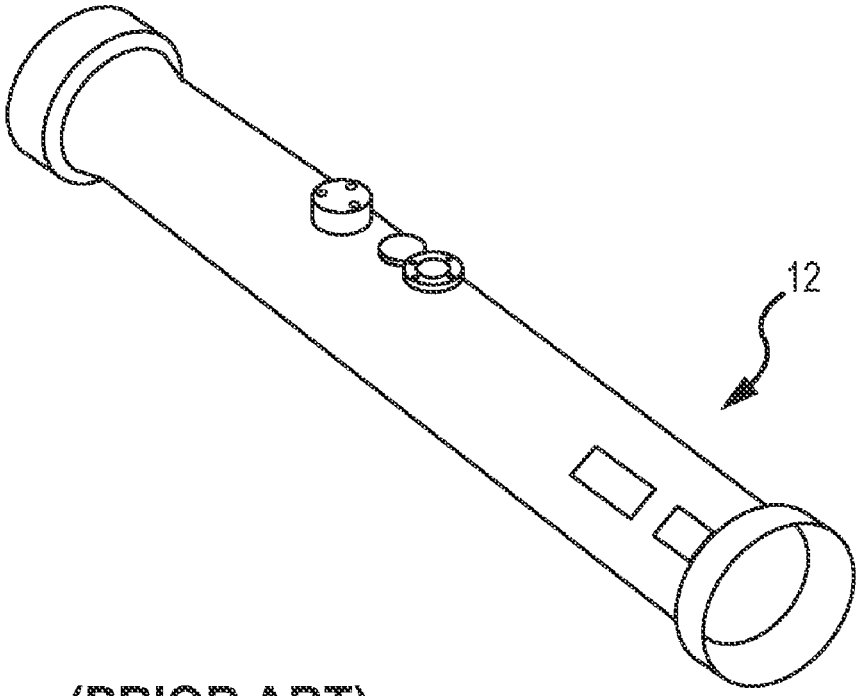
(PRIOR ART) FIG.1b
Figure 2A:
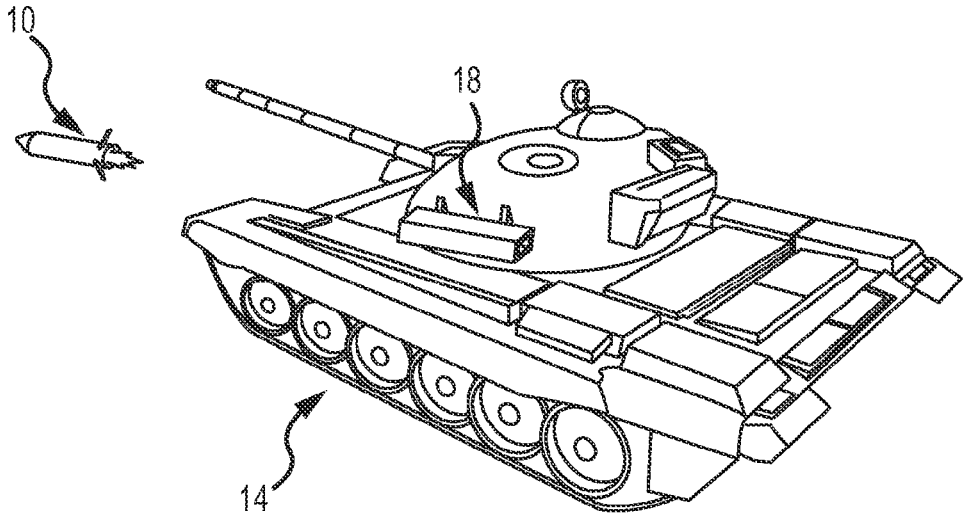
(PRIOR ART) FIG.2a
FIGS. 2*a* and 2*b*, as described above, are diagrams of existing TOW launch platforms.
Figure 2B:
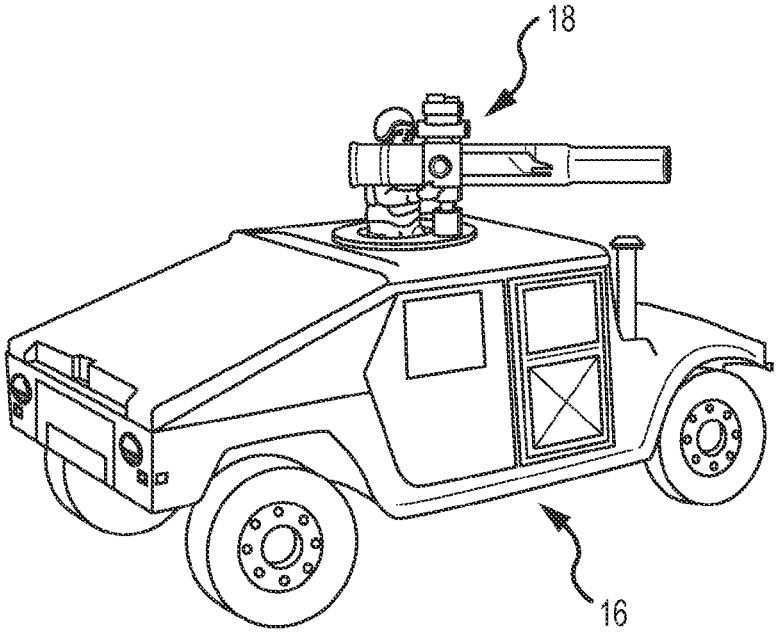
(PRIOR ART) FIG.2b
Figure 3:
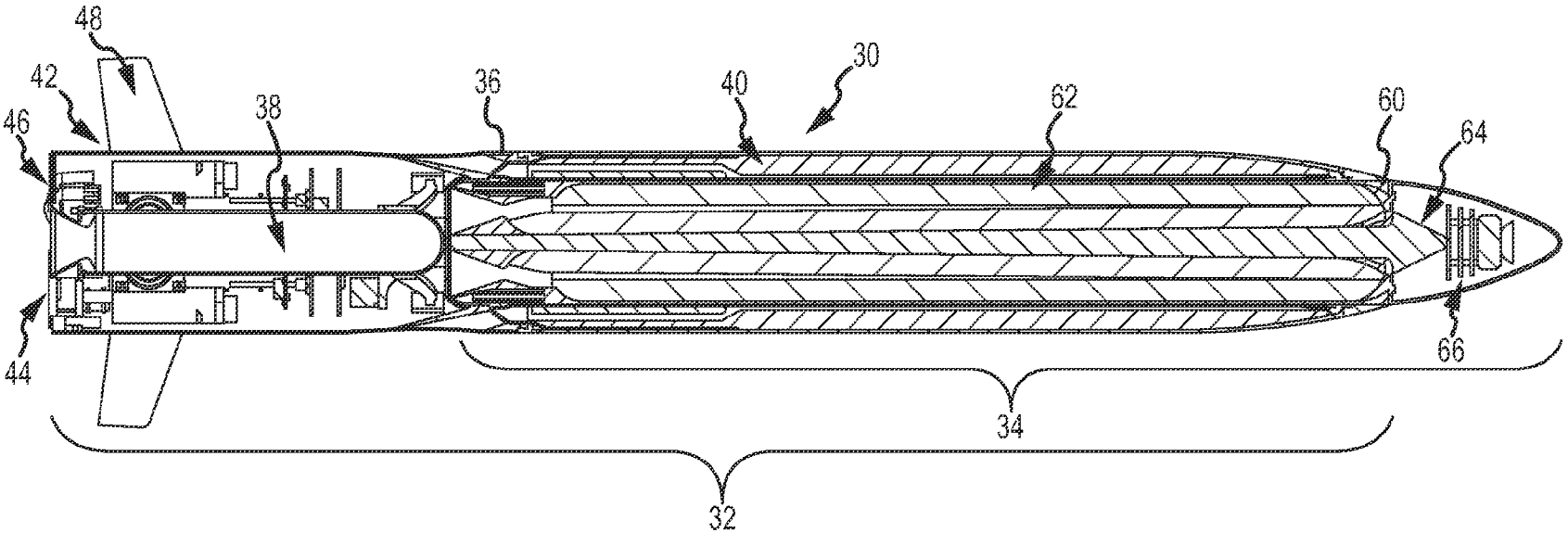
FIG. 3 is a diagram of a TOW-compatible multi-stage hyper-velocity KE missile (HVKEM) including a first stage flight missile and a second stage KE kill missile in accordance with the present invention.
Figure 4:
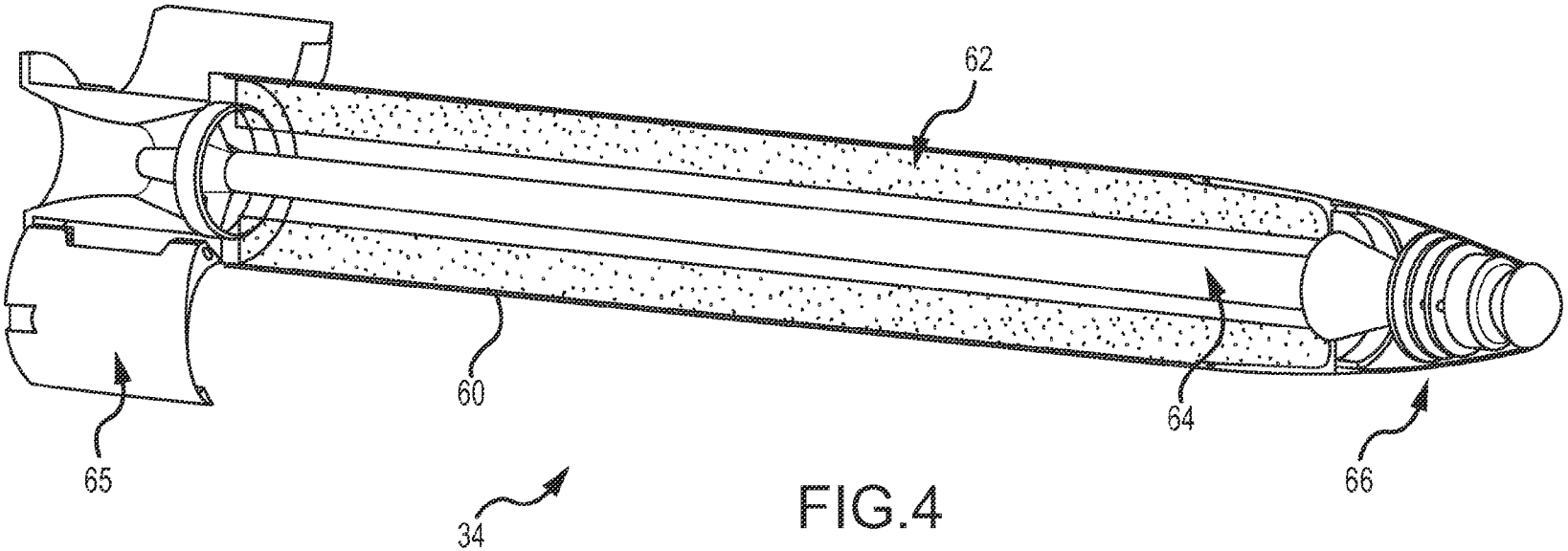
FIG. 4 is a diagram of the second stage KE kill missile.

As shown in FIGS. 3 and 4, a multi-stage hyper-velocity KE missile (HVKEM) 30 includes a $1^{st}$ stage flight missile 32 and a $2^{nd}$ stage KE kill missile 34. Flight missile 32 includes a body structure 36, a launch motor 38 to launch the flight missile, a flight motor 40 to sustain flight at velocities less than Mach 1.5 and often sub-sonic, and a command line-of-sight (CLOS) flight control system 42 co-located with the launch motor and responsive to guidance commands issued from a CLOS guidance system on a launch platform to maneuver the missile to a target. The launch and flight motors suitably use a minimum smoke propellant chemistry so that the TOW operator can see the target and guide the missile to impact.

Flight control system 42 suitably includes a beacon 44 on the tail of the flight missile, an RF link 46 to receive guidance commands from the CLOS guidance system, a plurality of fins 48 and CAS to maneuver the flight missile, a battery, electronics (autopilot), a safe & arm for the missile and an inertial sensor. The CLOS guidance system includes a sight for acquiring an aimpoint on the target, an optical sensor that images both the target and the tail beacon 44, a computer to compute the guidance commands and an RF link to transmit the guidance commands to the flight missile. Note, the RF link could be replaced with a wire or other communication link.

Kill missile 34 positioned in the body structure 36 of flight missile 32 includes a body structure 60, a boost motor 62, a KE-rod penetrator 64 suitably >30 inches in length, approximately 1 inch in diameter and made of tungsten, fins 65 to stabilize the missile and a range sensor 66 to detect when the target is within a lethal range of the KE-rod penetrator to trigger separation of the kill missile from the flight missile within one second to impact and ignition of the boost motor to boost the kill missile to velocities greater than Mach 3 to impact the target. The boost motor suitably uses high-impulse very smokey propellant chemistry in order to boost the kill missile to speeds greater than Mach 3 and typically hyper-velocities.

Figure 5:
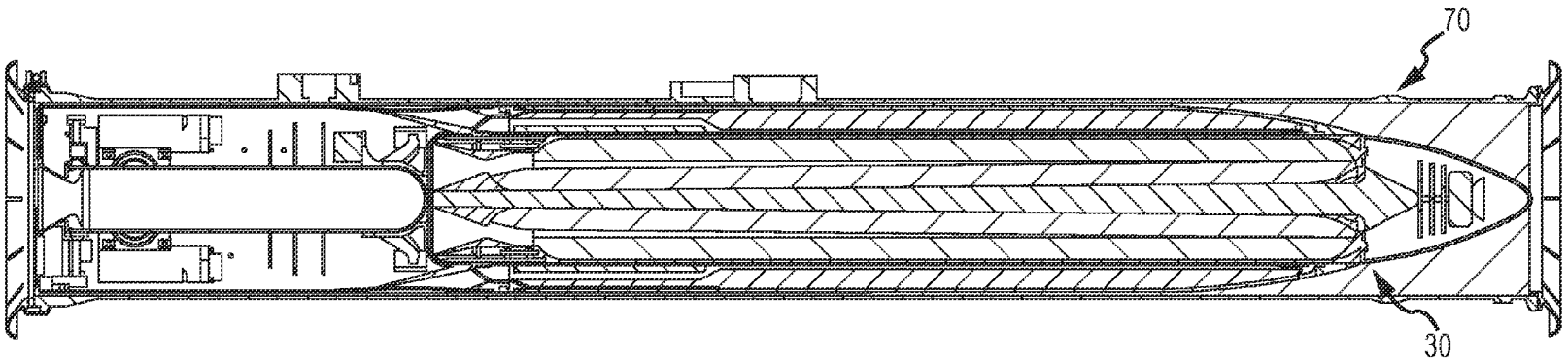
FIG. 5 is a diagram of the HVKEM within the standard TOW launch container.
Figure 6A:
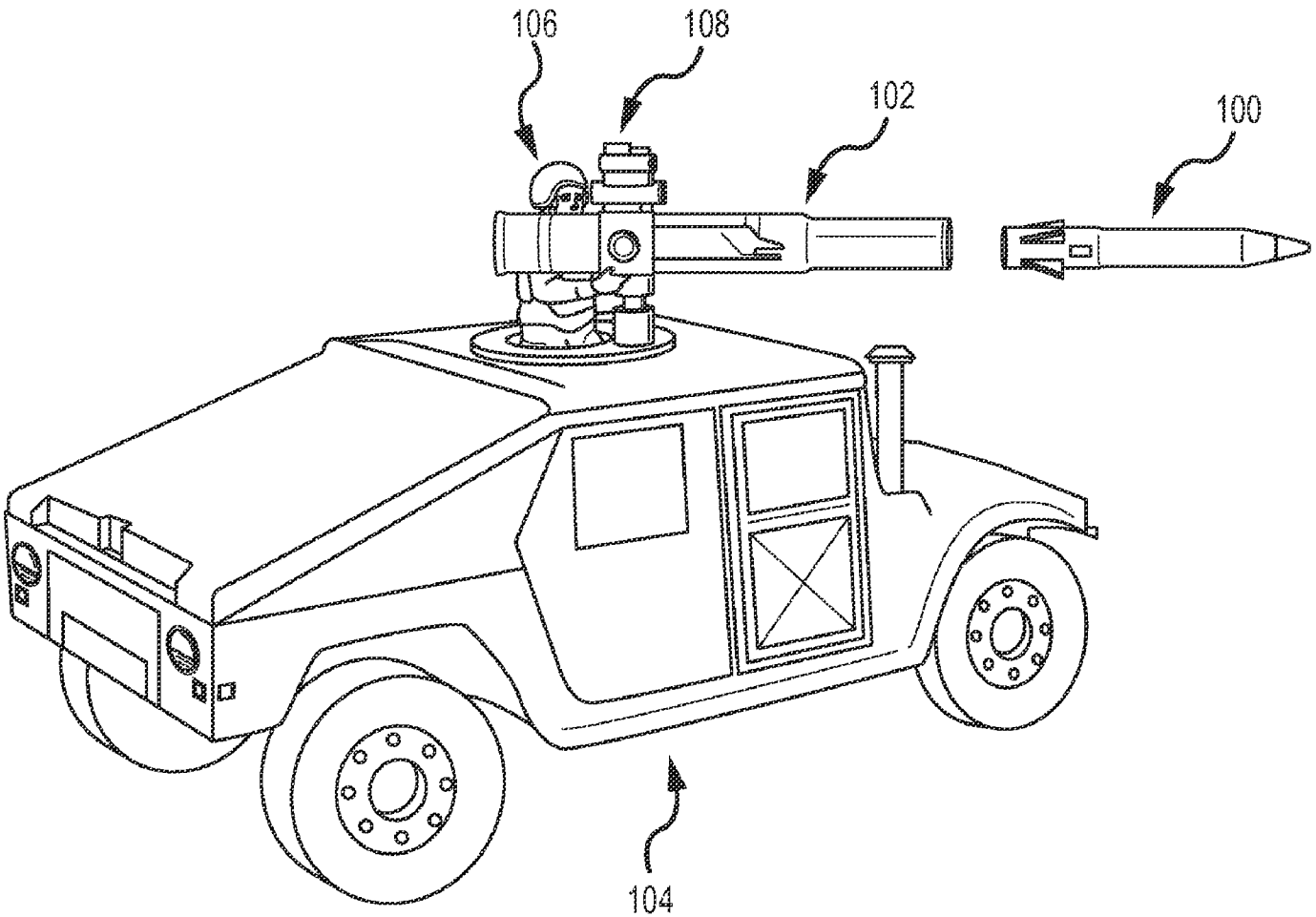
Figure 6C:
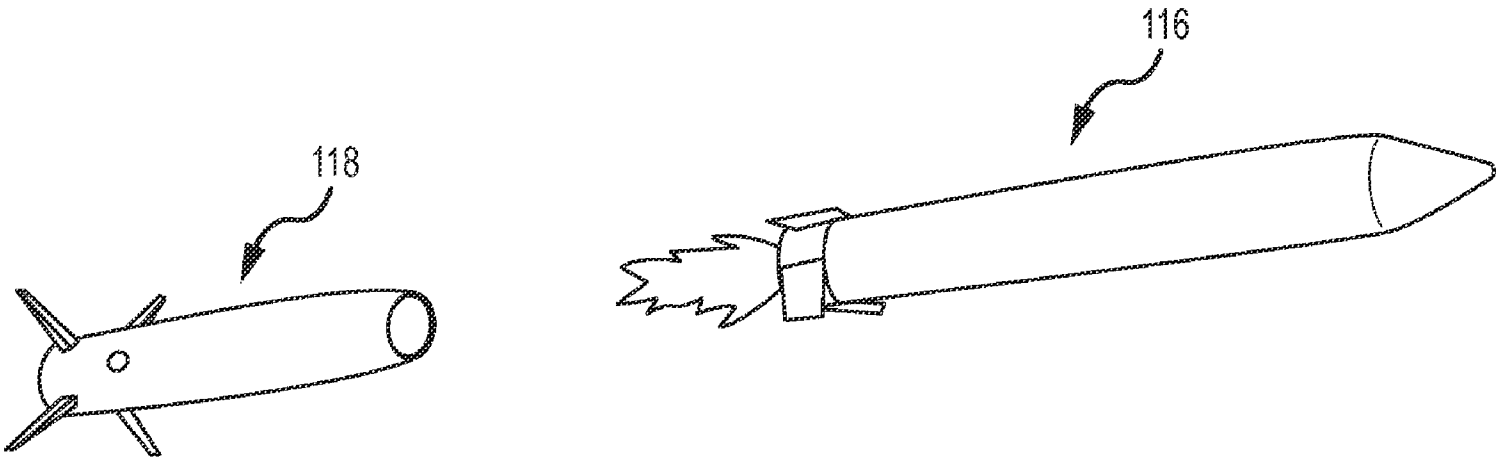
Figure 6D:
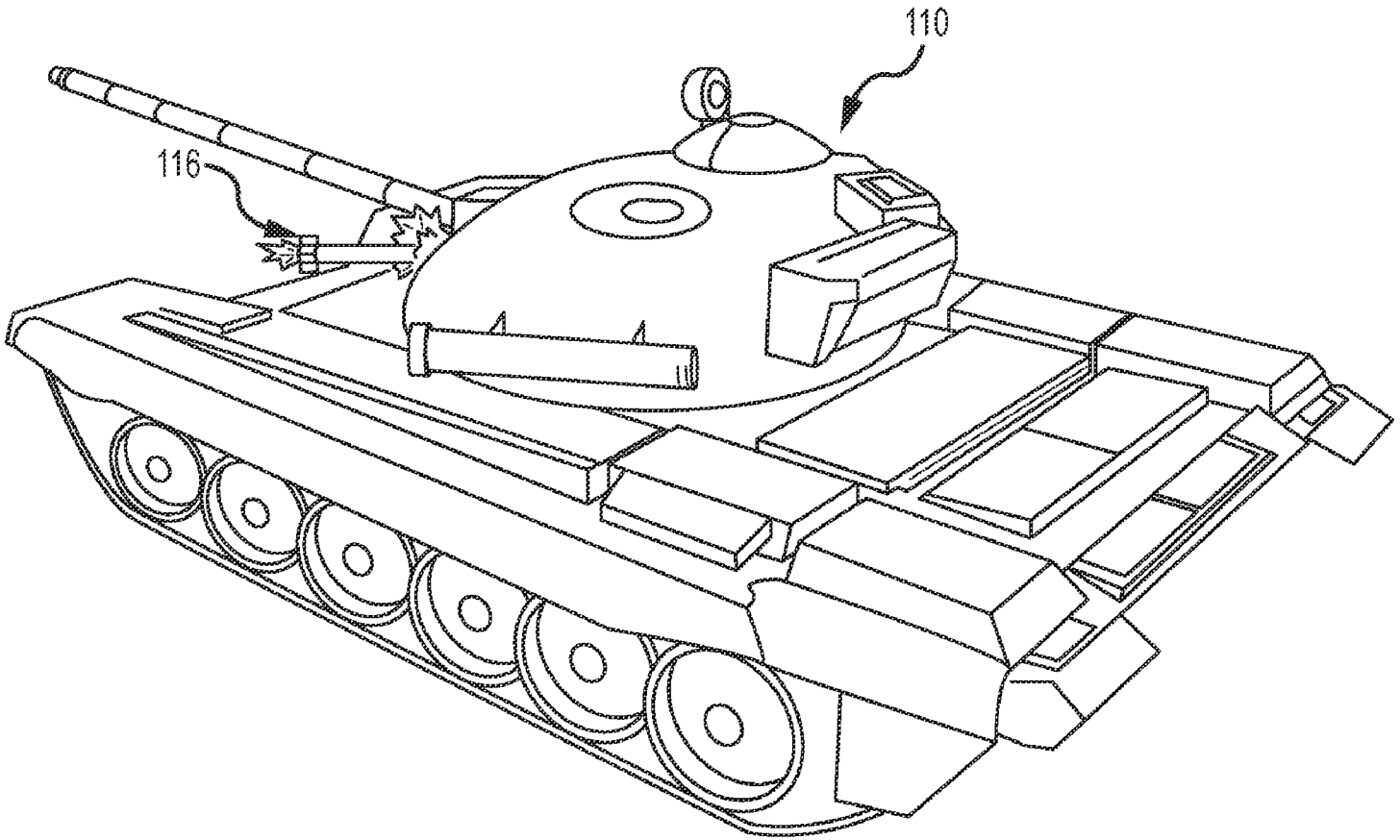
Figure 6E:
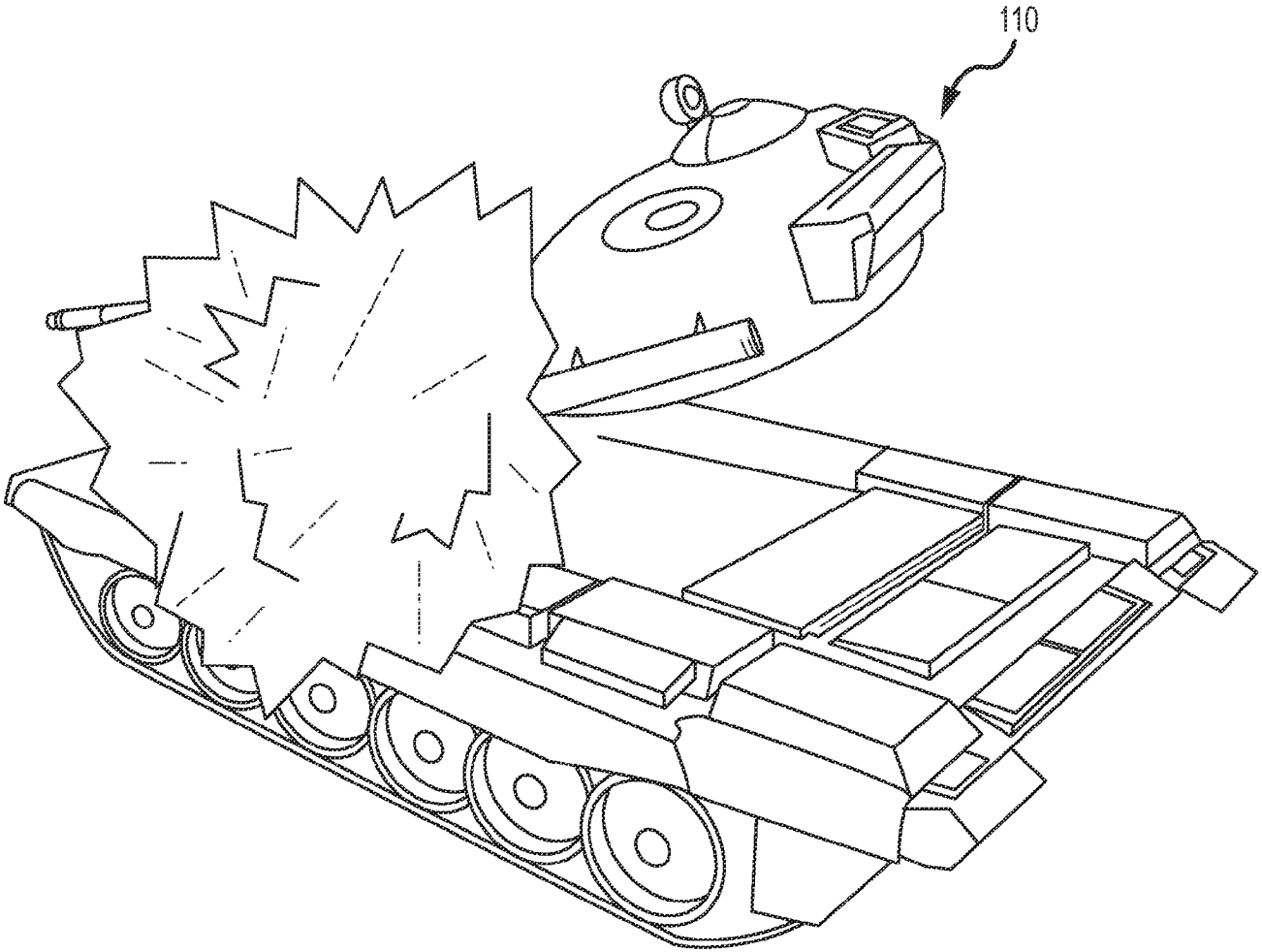
Figure 7:
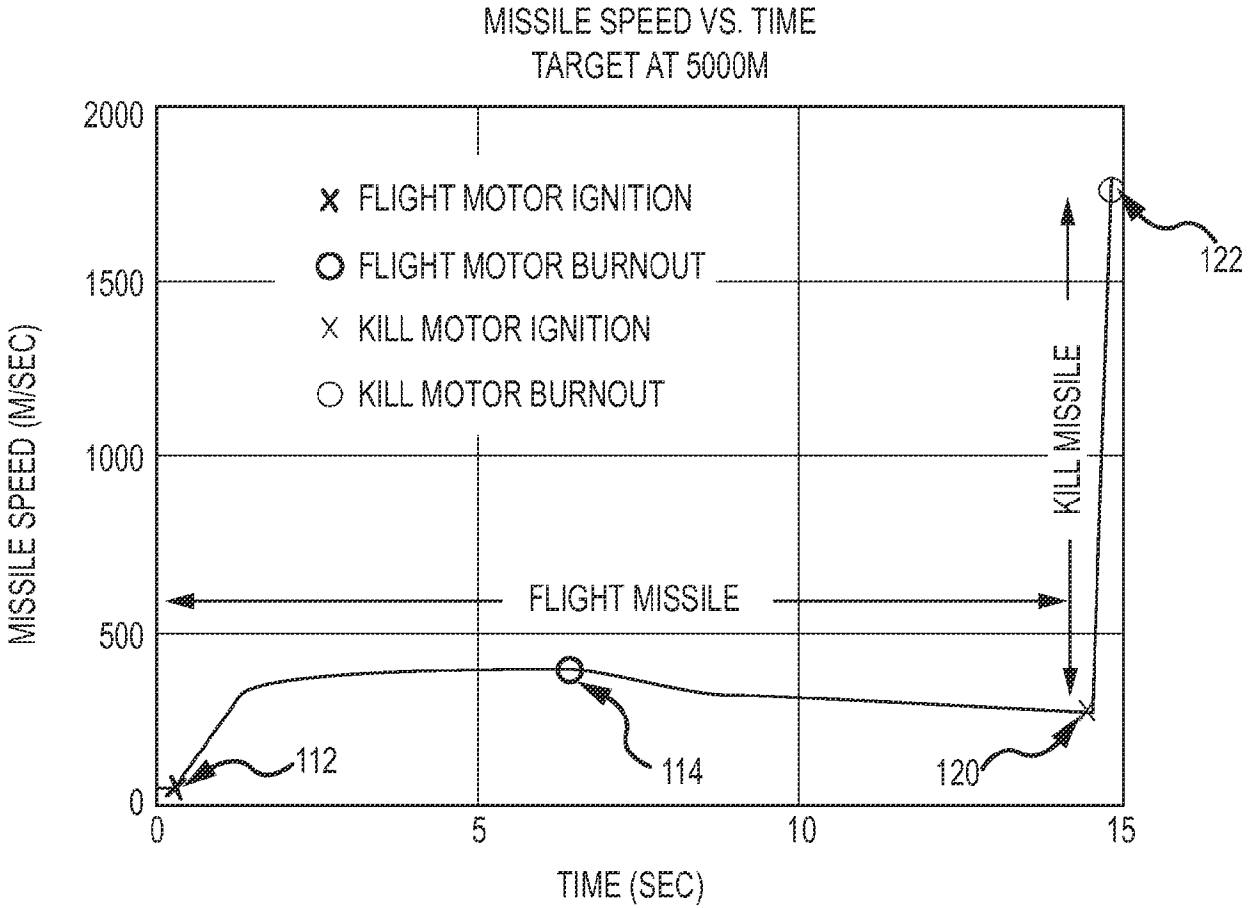
FIG. 7 is a plot of missile speed versus time for the missile launch, flight and impact on target.

The HVKEM 30 has an all-up weight less than 70 lbs, a length no greater than 5 feet and a diameter no greater than 6 inches compatible with a TOW launch container 70 as shown in FIG. 5. The HVKEM 30 is loaded, stored, launched and command guided to target as if it were a standard chemical-explosive TOW missile. Thus, the HVKEM can be used with the existing base of TLCs and TOW launch platforms without modification.

FIGS. 6*a*-6*e* and 7 illustrate a typical launch sequence for a HVKEM to engage a target at 5,000 meters. A HVKEM 100 is stored in a TLC 102 mounted on a TOW platform 104. A soldier 106 mans a CLOS guidance system 108. The soldier points the sight on a hostile tank 110, selects the "HV-TOW" icon from a display, selects the KE penetrator mode and launches the weapon igniting the launch motor. A fraction of a second after the HVKEM clears the TLC the flight motor ignites (112) and burns for roughly 7 seconds until burnout (114). The HVKEM will slow down as it cruises to a velocity <Mach 1.5 and in this example <Mach 1. At a temperature of 15 degrees Celsius at sea level Mach 1 is approximately 340 m/s. At a range of a few hundred meters to target, less than 1 second and typically less than ½ second to impact, the kill missile 116 separates from the flight missile 118 and the boost motor ignites (120) and burns for less than a second until burnout (122) at or shortly prior to impacting tank 110. The boost motor accelerates the kill missile 116 to velocities in excess of Mach 3 and, in this example, to hyper-velocity in excess of Mach 5. The soldier maintains the aimpoint on the tank until impact. Up to the point of separation, the flight control system can respond to guidance commands and maneuver the missile to maintain the aimpoint. The time between separation and impact is so short, less than a second, that aiming error caused by motion post-separation is minimal for typical classes of targets, e.g. tanks.

Figure 8:
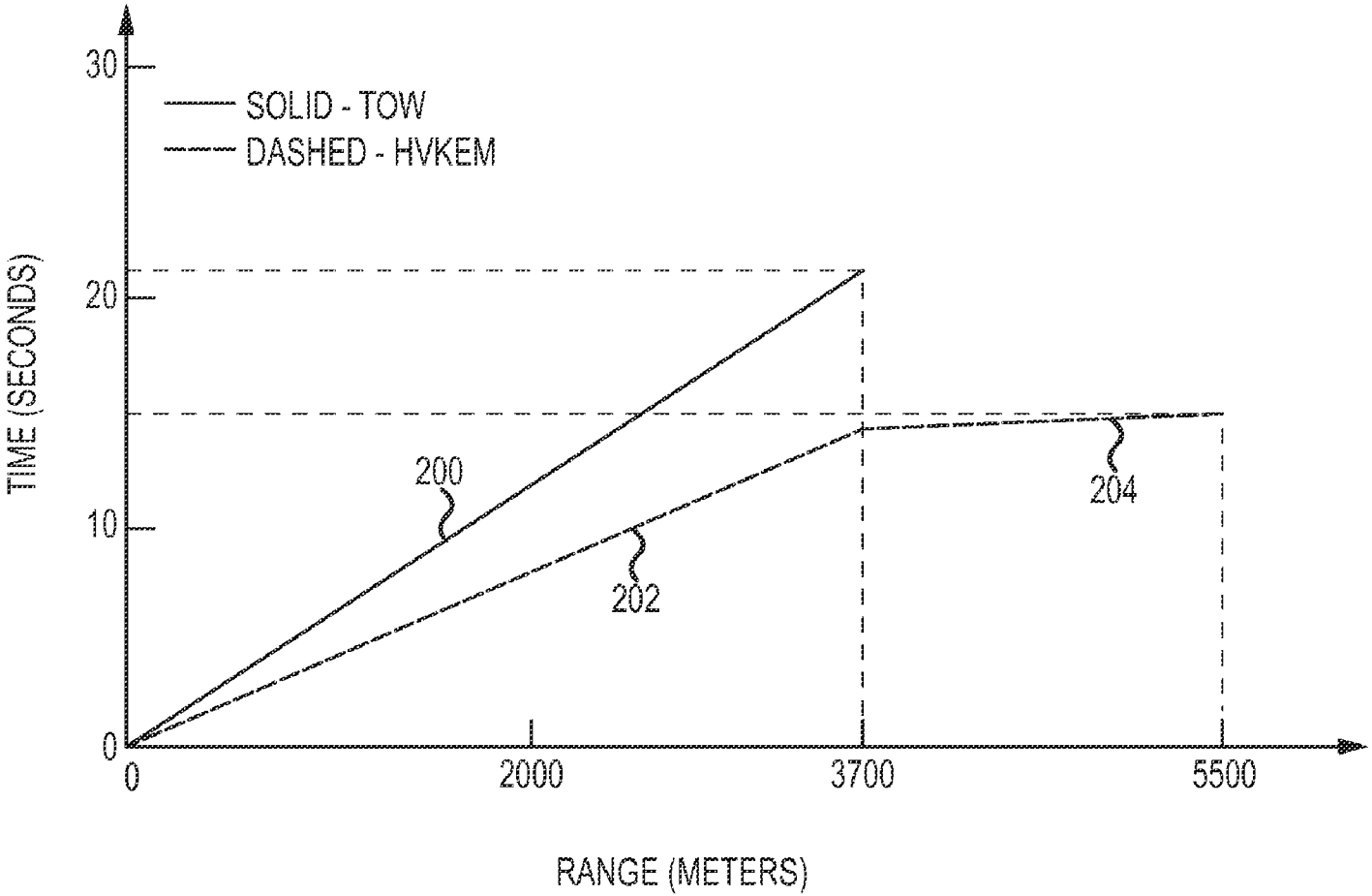
FIG. 8 is time of flight plot comparing the hyper-velocity missile to a standard TOW missile.

FIG. 8 is a time of flight (TOF) plot for both a conventional TOW and a HVKEM-TOW. A standard TOW cruises at an approximately uniform velocity 200 (there is some slow down after the flight motor burns out) to reach a range of 3700 meters in roughly 22 seconds. The HVKEM cruises at below Mach 1.5 202 for approximately 14 seconds and then launches the kill missile above Mach 5 204 for less than 1 second to reach a range of 5500 meters in about 15 seconds. The increased range allows the HVKEM to prosecute a larger battle space. The reduced TOF makes it more difficult for the enemy to employ effective countermeasures.

Without TOW constraints on physical size and weight, operation and CLOS guidance the HVKEM may be configured to be larger and heavier for a different mission and/or to use a different guidance system without departing from the principles of the "missile in a missile design", namely flying the flight missile at a relatively slow velocity, less than Mach 1.5, to both reduce propellant consumed and to enable guidance to the target and 'at the last second' separating and boosting the unguided kill missile to a relative high velocity, greater than Mach 3 and preferably hyper-velocity, to impact the target.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A multi-stage hyper-velocity kinetic energy missile (HVKEM), comprising:

a flight missile including a flight missile body structure, a launch motor to launch the flight missile, a flight motor to sustain flight at velocities less than Mach 1.5, and a flight control system responsive to guidance commands to maneuver the missile to a target; and a kill missile in the flight missile body structure including a kill missile body structure, a boost motor, a KE-rod penetrator, and a range sensor to detect when the target is within a lethal range of the KE-rod penetrator to trigger separation of the kill missile from the flight missile and ignition of the boost motor to boost the kill missile to velocities greater than Mach 3 to impact the target.

2. The multi-stage hyper-velocity missile of claim 1, wherein the flight missile's launch and flight motor burn non-smokey propellant.

3. The multi-stage hyper-velocity missile of claim 1, wherein the flight motor sustains flight at a velocity less than Mach 1.

4. The multi-stage hyper-velocity missile of claim 1, wherein the flight control system is a command line of sight (CLOS) system that is responsive to guidance commands issued from a CLOS system on a launch platform.

5. The multi-stage hyper-velocity missile of claim 1, wherein the kill missile's boost motor achieves a velocity greater than Mach 5.

6. The multi-stage hyper-velocity missile of claim 1, wherein the kill missile's boost motor burns smokey propellant.

7. The multi-stage hyper-velocity missile of claim 1, wherein separation is triggered at less than one second to target impact.

8. The multi-stage hyper-velocity missile of claim 1, wherein separation is triggered at less than a half-second to target impact.

9. The multi-stage hyper-velocity missile of claim 1, wherein the kill missile does not include a flight motor.

10. The multi-stage hyper-velocity missile of claim 1, wherein the kill missile is unguided once separated.

11. The multi-stage hyper-velocity missile of claim 10, wherein the kill missile includes a plurality of fins to maintain the heading at separation.

12. The multi-stage hyper-velocity missile of claim 1, wherein the HVKEM is configurable as a dual-mode missing including a $1^{st}$ mode in which the kill missile separates, boosts to a velocity greater than Mach 3 and impacts the target and a $2^{nd}$ mode in which the kill missile does not separate and the flight missile flies at less than Mach 1.5 to impact the target thereby detonating the propellant of the kill missile boost motor.

13. The multi-stage hyper-velocity missile of claim 12, wherein the HVKEM is configured to select either the mode or the $2^{nd}$ mode prior to launch.

14. A Tube-Launched, Optically-Tracked, Wire-Guided (TOW) compatible multi-stage hyper-velocity kinetic energy missile (HVKEM), comprising:

a flight missile including a flight missile body structure, a launch motor to launch the flight missile, a flight motor to sustain flight at velocities less than Mach 1.5, and a command line-of-sight (CLOS) flight control system co-located with the launch motor and responsive to guidance commands issued from a CLOS guidance system on a launch platform to maneuver the missile to a target; and a kill missile in the flight missile body structure including a kill missile body structure, a boost motor, a KE-rod penetrator, and a range sensor to detect when the target is within a lethal range of the KE-rod penetrator to trigger separation of the kill missile from the flight missile within one second to impact and ignition of the boost motor to boost the kill missile to velocities greater than Mach 3 to impact the target, said HVKEM having an all-up weight less than 70 lbs, a length no greater than 5 feet and a diameter no greater than 6 inches compatible with a TOW launch container.

15. A Tube-Launched, Optically-Tracked, Wire-Guided (TOW) missile system, comprising:

a TOW launch platform;

a TOW launch container mounted on the platform;

a command line of sight (CLOS) guidance system to acquire and track a target; and a multi-stage hyper-velocity kinetic energy missile (HVKEM) stored in the TOW launch container, comprising:

a flight missile including a flight missile body structure, a launch motor to launch the flight missile, a flight motor to sustain flight at velocities less than Mach 1.5, and a command line-of-sight (CLOS) flight control system co-located with the launch motor and responsive to guidance commands issued from a CLOS guidance system on a launch platform to maneuver the missile to the target; and a kill missile in the flight missile body structure including a kill missile body structure, a boost motor, a KE-rod penetrator, and a range sensor to detect when the target is within a lethal range of the KE-rod penetrator to trigger separation of the kill missile from the flight missile within one second to impact and ignition of the boost motor to boost the kill missile to velocities greater than Mach 3 to impact the target, said HVKEM having an all-up weight less than 70 lbs, a length no greater than 5 feet and a diameter no greater than 6 inches compatible with the TOW launch container.

* * * * *